US005106815A

United States Patent [19]

Akada et al.

[11] Patent Number: 5,106,815

[45] Date of Patent: Apr. 21, 1992

[54] HEAT TRANSFER SHEET

[75] Inventors: Masanori Akada; Jumpei Kanto; Hitoshi Saito; Hiroshi Eguchi; Masayuki Nakamura, all of Tokyo; Junji Chiba; Kaoru Suda, both of Hiratsuka, all of Japan

[73] Assignee: Dai Nippon Insatsu Kabushiki Kaisha, Japan

[21] Appl. No.: 560,846

[22] Filed: Jul. 31, 1990

[30] Foreign Application Priority Data

Aug. 2, 1989 [JP] Japan ..... 1-202231

[51] Int. Cl.[5] ..... B41M 5/035; B41M 5/26

[52] U.S. Cl. ..... 503/229; 428/195; 428/913; 428/914

[58] Field of Search ..... 8/471; 428/195, 913, 428/914

[56] References Cited

U.S. PATENT DOCUMENTS 4,743,581 5/1988 Gregory ..... 503/227

*Primary Examiner*—Bruce H. Hess

*Attorney, Agent, or Firm*—Parkhurst, Wendel & Rossi

[57] ABSTRACT

A heat transfer sheet including a substrate sheet and a dye carrier layer formed on one side of the substrate sheet is characterized in that the dye included in the dye carrier layer is a dye containing chromophores resulting from at least two azo bonds linked together through a non-conjugated linking group.

5 Claims, No Drawings

HEAT TRANSFER SHEET

BACKGROUND OF THE INVENTION

The present invention relates to a heat transfer sheet. More particularly, the present invention has for its object the provision of a heat transfer sheet which can make a recorded image excelling in color density, clearness and fastness properties, especially storability and resistance to discoloration/fading.

Various heat transfer techniques heretofore known in the art include a sublimation heat transfer technique in which a sublimable dye is carried on a substrate sheet such as paper as a recording medium to form a heat transfer sheet. The heat transfer sheet is then overlaid on a material to be transferred, which is dyeable with the sublimable dye, such as a polyester woven fabric. A heat energy is finally applied to the assembly from the back side of the heat transfer sheet in a patterned form to transfer the sublimable dye onto the material to be transferred.

In recent years, it has also been proposed to make use of the above-mentioned sublimation type of heat transfer technique to form various full-color images on paper or plastic films. In this case, the heating means used is a thermal head of a printer which can transfer a number of color dots of three or four colors onto the material to be transferred by very short heating, thereby reproducing a full-color image of a manuscript with the multicolor dots.

The thus formed image is very clear and excels in transparency due to the coloring material used being a dye, so that it can be improved in terms of the reproducibility of neutral tints and gradation. Thus, it is possible to form a high-quality image equivalent to an image achieved by conventional offset or gravure printing and comparable to a full-color photographic image.

The most serious problem with the above-mentioned heat transfer technique, however, arises in connection with the color density, storability and resistance to discoloration/fading of the formed image.

In other words, a heat energy for fast recording should be applied within as short a time as possible, say, the fraction of a second. Within such a short time, however, the sublimable dye and the material to be transferred cannot fully be heated, thus failing to form an image of sufficient density.

For that reason, a sublimable dye having an improved sublimability has been developed to accommodate such fast recording. However, since the sublimable dye of an improved sublimability has generally a low molecular weight, it is likely to migrate or bleed through the material subjected to heat transfer, as time goes by. This leads to a storability problem that the formed image may become out of order or blurred, or otherwise contaminate surrounding articles.

In order to avoid such a problem, it has been proposed to use a sublimable dye having a relatively high molecular weight. With this, however, it has been impossible to form any image of satisfactory density, since its rate of sublimation is insufficient for such a fast recording technique as mentioned above.

Another problem is that because of being formed by the dye, the resulting image is generally so inferior in light resistance to a pigmented image that it fades or discolors prematurely upon exposure to direct sunlight. This light resistance problem may be solved to some extent by adding UV absorbers or antioxidants to a dye-receiving layer of the material to be transferred.

However, the discoloration/fading problems arise not only by direct sunlight but also by other light, e.g., indoor light, or even under conditions not directly exposed to light, e.g., in albums, cases and books. These indoor or in-the-dark discoloration/fading problems can never be solved by using general UV absorbers or antioxidants.

SUMMARY OF THE INVENTION

It is therefore an object of this invention to provide a heat transfer sheet used with a heat transfer technique making use of a sublimable dye, which can give a clear image of not only sufficient density but also improved fastness properties, esp., improved storability and resistance to discoloration/fading.

The above-mentioned object is achievable by the present invention which will be described in greater detail.

Briefly, the present invention provides a heat transfer sheet comprising a substrate sheet and a dye carrier layer formed on one major side of the substrate sheet, characterized in that the dye included in the dye carrier layer is a dye containing chromophores resulting from at least two azo bonds linked together through a non-conjugated linking group.

The dye used includes per molecule at least two chromophores by way of a non-conjugated linking group and, due to its improved color-developing efficiency, provides a heat transfer sheet capable of making a recorded image of increased density and improved fastness properties, especially storability and resistance to discoloration/fading.

BEST MODE FOR CARRYING OUT THE INVENTION

The present invention will now be explained in greater detail with reference to the preferred embodiments.

The dye used in this invention is characterized in that at least two azo type chromophores are linked together through a non-conjugated linking group and, for instance, may be expressed in terms of the following general formula (I):

$$\text{ti } A—Y—(B)_n \qquad (I)$$

where A and $(B)_n$ each stand for an azo group containing chromophore, Y a non-conjugated linking group and n an integer of 1 or more, preferably 1.

In the above-mentioned general formula (I), A or $(B)_n$ assumes a mono- or dis-azo dye structure having no water-soluble group as a substituent. In particular, it is suitably a monoazo dye having a structure similar to those of conventional disperse, oil-soluble and sublimable dyes. The chromophores represented by A and $(B)_n$ may be of an identical or different structure and of an identical or different hue.

The aromatic or heteroaromatic rings of the structures containing the azo chromophores represented by A and B, which take part in conjugated systems, includes aromatic rings such as benzene, naphthalene and anthracene. Additional mention is made of heteroaromatic rings such as furan, thiophene, pyrrole, 2H-pyrrole, benzofuran, isobenzofuran, 1-benzothiophene, 2-benzothiophene, indole, isoindole, indolizine, carbazole, 2H-pyrane, 2H-chroman, 1H-2-benzopyrane, xanthene, 4H-thiopyrane, pyridine, quinoline, isoquinoline, 4H-quinolidine, phenanthridine, acridine, oxazole, isooxazole, thiazole, isothiazole, furazane, imidazole, purazole, benzimidazole, 1H-indazol, 1,8-naphthylidine, pyradine, pyrimidine, pyridazine, quinozaline, quinozaline, cinnoline, phthalazine, purine, puteridine, perymidine, 1,10-phenanthroline, thianthrene, phenoxatyin, phenoxazine, phenothiazine, phenazine and phenalsadine.

These rings may have one or more substituents such as a halogen atom; a cyano group; a hydroxyl group; and a thiol group; as well as alkyl, aryl, cycloalkyl, alkoxy, thioalkoxy, aralkyl, acylamino, sulfonylamino, ureido, carbamoyl, sulfamoyl, alkoxycarbonyl, allyloxycarbonyl, acyl and amino groups which may all be substituted.

Preferred azo type chromophores expressed by A or B in the general formula (I) are of the following structures.

(1)

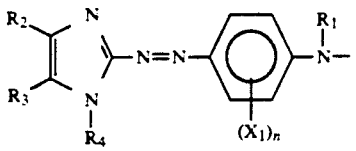

(2)

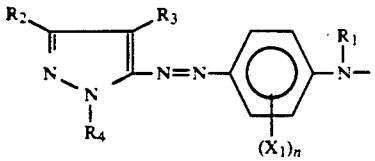

(3)

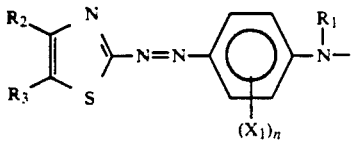

(4)

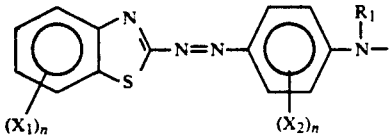

(5)

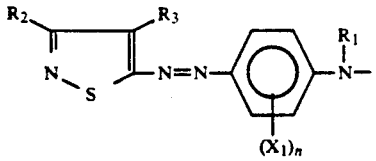

(6)

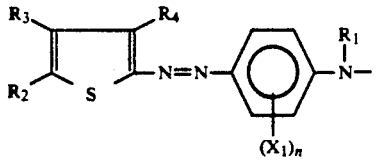

(7)

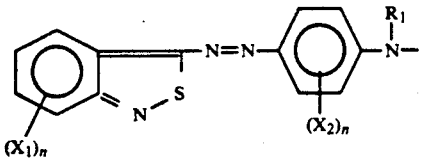

-continued (8)

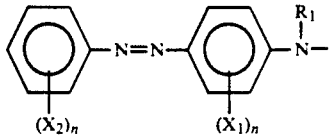

(9)

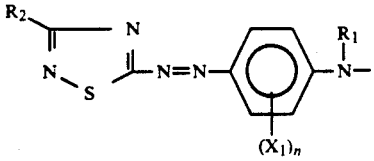

(10)

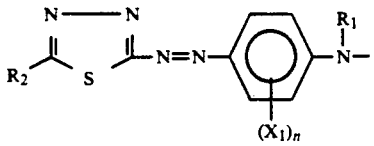

(11)

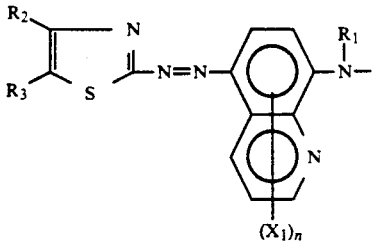

(12)

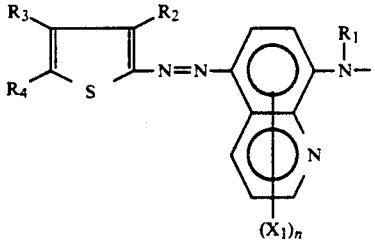

(13)

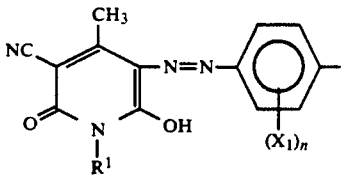

(14)

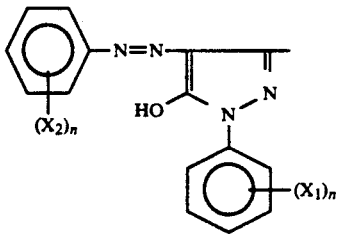

(15)

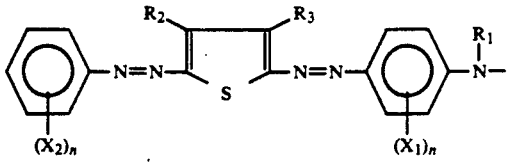

-continued (16)

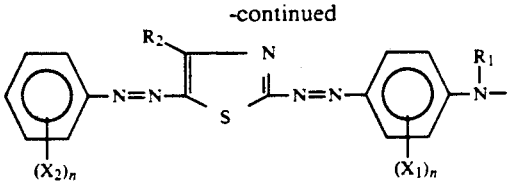

(17)

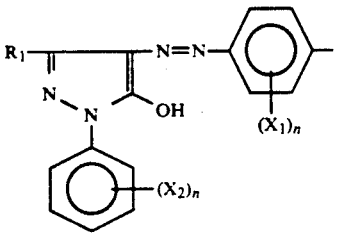

(18)

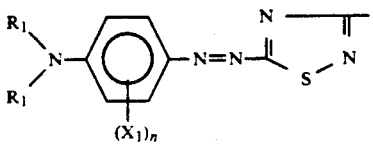

Various substituents in the above-mentioned formulae are the same as stated in connection with the aromatic or heteroaromatic rings.

Preferably, the linking groups expressed by Y in the general formula (I) may include unsubstituted or substituted alkylene groups such as ethylene, propylene, butylene, pentylene, hexylene, heptylene, octylene, bromoethylene, 2,3-dichloroethylene, 2-hydroxypropylene, 2,7-dihydroxyoctylene and 2-cyanobutylene, which may or may not have groups such as ether, thioether, carbonyl, amino, amido, imido, ureido, carbonyloxy, sulfonyl, sulfonylamino and vinyl groups.

The most preferable linking groups are $C_{2-10}$ alkylene groups which may contain different atoms such as oxygen, sulphur and nitrogen atoms.

The dyes preferably used in this invention have a molecular weight of 500 to 1,000, most preferably 800 or less, and a melting point of 200° C. or lower.

The dyes used in this present invention may be prepared according to conventional methods heretofore known for preparing azo dyes such as a method in which 2 moles of a mono- or dis-azo dye having a functional group are allowed to react with 1 mole of the linking group, a coupling reaction between a tetrazonium salt of diamine linked by way of the linking group and a coupler and a coupling reaction between a coupler linked by way of the linking group and an aromatic diazonium salt.

Illustrative examples of the dyes preferably used in this invention are summarized in Table 1.

TABLE 1

General Formula (A)

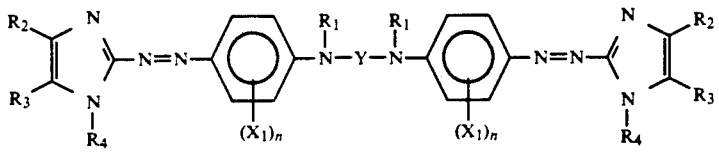

| No. | $R_1$ | $R_2$ | $R_3$ | $R_4$ | $X_1$ | n | Y | M.W. |
|---|---|---|---|---|---|---|---|---|
| 1 | $-C_4H_9$ | $-CN$ | $-CN$ | $-CH_2CN$ | $-CH_3$ | 1 | $-C_6H_{12}-$ | 774.0 |
| 2 | $-C_4H_9$ | $-CN$ | $-CN$ | $-CH_3$ | $-H$ | 1 | $-C_6H_{12}-$ | 696.0 |
| 3 | $-C_2H_5$ | $-CN$ | $-H$ | $-C_2H_5$ | $-OC_2H_5$ | 1 | $-C_8H_{16}-$ | 734.0 |
| 4 | $-C_4H_9$ | $-CN$ | $-CN$ | $-C_2H_5$ | $-NHCOC_2H_5$ | 1 | $-C_6H_{12}-$ | 866.0 |

General Formula (B)

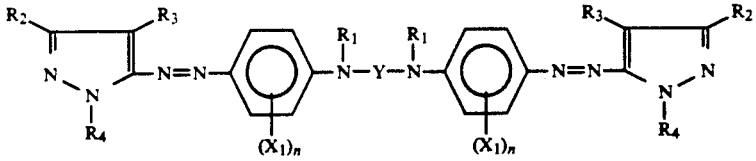

| No. | $R_1$ | $R_2$ | $R_3$ | $R_4$ | $X_1$ | n | Y | M.W. |
|---|---|---|---|---|---|---|---|---|
| 1 | $-C_4H_9$ | $-CN$ | $-CN$ | $-CH_2CN$ | $-CH_3$ | 1 | $-C_6H_{12}-$ | 774.0 |
| 2 | $-C_4H_9$ | $-H$ | $-CH_3$ | $-CH_3$ | $-H$ | 1 | $-C_6H_{12}-$ | 624.0 |
| 3 | $-C_2H_5$ | $-H$ | $-Cl$ | $-CH_3$ | $-OC_2H_5$ | 1 | $-C_8H_{16}-$ | 725.0 |
| 4 | $-C_4H_9$ | $-H$ | $-H$ | $-C_2H_5$ | $-NHCOC_2H_5$ | 1 | $-C_6H_{12}-$ | 766.0 |
| 5 | $-C_3H_7$ | $-OH$ | $-CH_3$ | $-Ph$ | $-CH_3$ | 1 | $-C_6H_{12}-$ | 780.0 |
| 6 | $-C_2H_5$ | $-OH$ | $-COOCH_3$ | $-Ph$ | $-H$ | 1 | $-C_4H_8-$ | 784.0 |
| 7 | $-C_2H_5$ | $-H$ | $-H$ | $-CH_3$ | $-H$ | 1 | $-C_4H_8-$ | 512.0 |

General Formula (C)

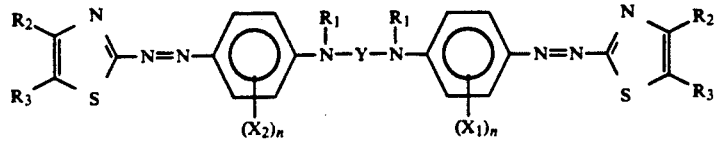

| No. | $R_1$ | $R_2$ | $R_3$ | $X_1$ | n | Y | M.W. |
|---|---|---|---|---|---|---|---|

TABLE 1-continued

| | | | | | | | |
|---|---|---|---|---|---|---|---|
| 1 | $-C_2H_5$ | $-H$ | $-NO_2$ | $-CH_3$ | 1 | $-C_6H_{12}-$ | 664.0 |
| 2 | $-C_4H_9$ | $-H$ | $-NO_2$ | $-OC_2H_5$ | 1 | $-C_6H_{12}-$ | 780.0 |
| 3 | $-C_4H_9$ | $-H$ | $-NO_2$ | $-NHCOCH_3$ | 1 | $-C_8H_{16}-$ | 834.0 |
| 4 | $-C_2H_5$ | $-CH_3$ | $-CH_3$ | $-H$ | 1 | $-C_6H_{12}-$ | 602.0 |

General Formula (D)

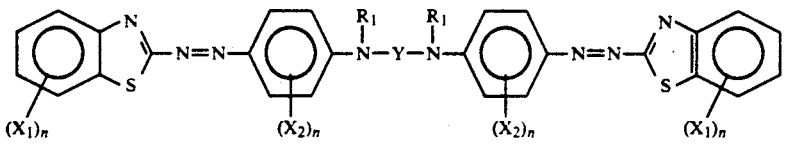

| No. | $R_1$ | $X_1$ | n | $X_2$ | n | Y | M.W. |
|---|---|---|---|---|---|---|---|
| 1 | $-C_4H_9$ | $-CH_3$ | 1 | $-NHCOCH_3$ | 1 | $-C_6H_{12}-$ | 844.0 |
| 2 | $-C_2H_5$ | $-CH_3$ | 1 | $-Cl$ | 1 | $-C_6H_{12}-$ | 743.0 |
| 3 | $-C_4H_9$ | $-Cl$ | 1 | $-H$ | 1 | $-C_6H_{12}-$ | 771.0 |
| 4 | $-C_4H_9$ | $-NO_2$ | 1 | $-CH_3$ | 1 | $-C_8H_{16}-$ | 848.0 |

General Formula (E)

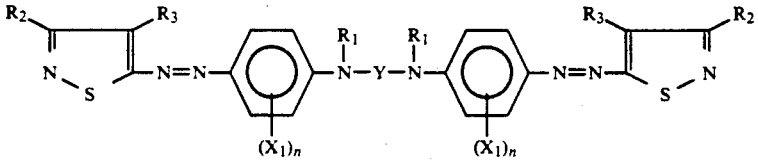

| No. | $R_1$ | $R_2$ | $R_3$ | $X_1$ | n | Y | M.W. |
|---|---|---|---|---|---|---|---|
| 1 | $-C_4H_9$ | $-CH_3$ | $-CN$ | $-CH_3$ | 1 | $-C_8H_{16}-$ | 736.0 |
| 2 | $-C_4H_9$ | $-CH_3$ | $-CN$ | $-OC_2H_5$ | 1 | $-C_6H_{12}-$ | 768.0 |
| 3 | $-C_2H_5$ | $-CH_3$ | $-CN$ | $-NHCOCH_3$ | 1 | $-C_6H_{12}-$ | 738.0 |
| 4 | $-C_4H_9$ | $-CH_3$ | $-CN$ | $-NHSO_2CH_3$ | 1 | $-C_4H_8-$ | 838.0 |

General Formula (F)

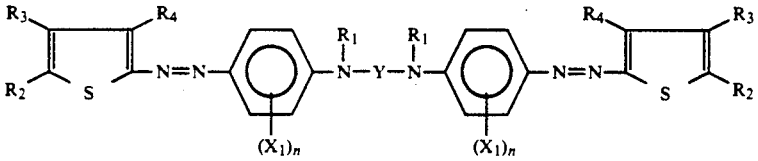

| No. | $R_1$ | $R_2$ | $R_3$ | $R_4$ | $X_1$ | n | Y | M.W. |
|---|---|---|---|---|---|---|---|---|
| 1 | $-C_2H_5$ | $-NO_2$ | $-H$ | $-CN$ | $-CH_3$ | 1 | $-C_6H_{12}-$ | 712.0 |
| 2 | $-C_4H_9$ | $-NO_2$ | $-H$ | $-COOC_2H_5$ | $-H$ | 1 | $-C_6H_{12}-$ | 834.0 |
| 3 | $-C_4H_9$ | $-NO_2$ | $-H$ | $-NO_2$ | $-CH_3$ | 1 | $-C_8H_{16}-$ | 836.0 |
| 4 | $-C_4H_9$ | $-NO_2$ | $-CH_3$ | $-CN$ | $-CONHCH_3$ | 1 | $-C_6H_{12}-$ | 882.0 |
| 5 | $-C_4H_9$ | $-NO_2$ | $-H$ | $-C_2H_4COOCH_3$ | $-CH_3$ | 1 | $-C_6H_{12}-$ | 890.0 |
| 6 | $-C_4H_9$ | $-NO_2$ | $-H$ | $-CN$ | $-H$ | 1 | $-C_6H_{12}-$ | 740.0 |

General Formula (G)

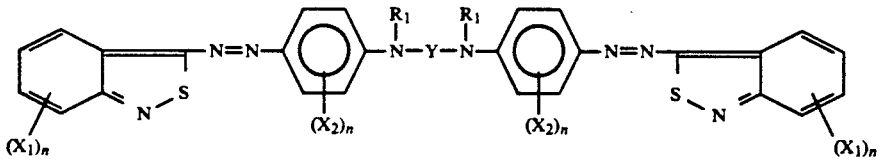

| No. | $R_1$ | $X_1$ | n | $X_2$ | n | Y | M.W. |
|---|---|---|---|---|---|---|---|
| 1 | $-C_4H_9$ | $-NO_2$ | 1 | $-Cl$ | 1 | $-C_6H_{12}-$ | 861.0 |
| 2 | $-C_2H_5$ | $-NO_2$ | 1 | $-CONHCH_3$ | 1 | $-C_6H_{12}-$ | 850.0 |
| 3 | $-C_4H_9$ | $-NO_2$ | 1 | $-CH_3$ | 1 | $-C_6H_{12}-$ | 820.0 |

General Formula (H)

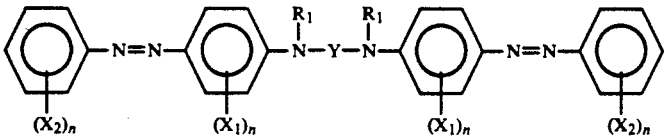

TABLE 1-continued

| No. | $R_1$ | $X_1$ | n | $X_2$ | n | Y | M.W. |
|---|---|---|---|---|---|---|---|
| 1 | $-C_4H_9$ | $-H$ | 1 | $-H$ | 1 | $-C_6H_{12}-$ | 588.0 |
| 2 | $-C_4H_9$ | $-H$ | 1 | -p-$NO_2$ | 1 | $-C_6H_{12}-$ | 678.0 |
| 3 | $-C_4H_9$ | $-OCH_3$ | 1 | -p-$NO_2$ -o-Cl | 2 | $-C_8H_{16}-$ | 803.0 |
| 4 | $-C_4H_9$ | $-H$ | 1 | -p-$NO_2$ -o-CN | 2 | $-C_6H_{12}-$ | 728.0 |
| 5 | $-C_4H_9$ | $-H$ | 1 | -p-$NO_2$ -o-CN -o-Br | 3 | $-C_6H_{12}-$ | 885.5 |

General Formula (I)

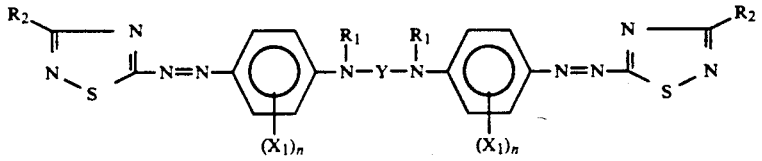

| No. | $R_1$ | $R_2$ | $X_1$ | n | Y | M.W. |
|---|---|---|---|---|---|---|
| 1 | $-C_2H_5$ | $-SC_2H_5$ | $-CH_3$ | 1 | $-C_6H_{12}-$ | 696.0 |
| 2 | $-C_4H_9$ | $-CN$ | $-OC_2H_5$ | 1 | $-C_6H_{12}-$ | 742.0 |
| 3 | $-C_2H_5$ | $-NO_2$ | $-NHCOCH_3$ | 1 | $-C_6H_{12}-$ | 752.0 |
| 4 | $-C_4H_9$ | $-Cl$ | $-H$ | 1 | $-C_8H_{16}-$ | 701.0 |

General Formula (J)

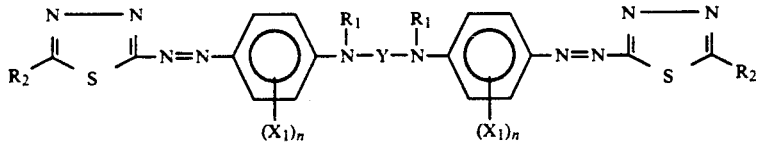

| No. | $R_1$ | $R_2$ | $X_1$ | n | Y | M.W. |
|---|---|---|---|---|---|---|
| 1 | $-C_2H_5$ | $-SC_2H_5$ | $-CH_3$ | 1 | $-C_6H_{12}-$ | 696.0 |
| 2 | $-C_4H_9$ | $-CN$ | $-OC_2H_5$ | 1 | $-C_6H_{12}-$ | 742.0 |
| 3 | $-C_2H_5$ | $-NO_2$ | $-NHCOCH_3$ | 1 | $-C_6H_{12}-$ | 752.0 |
| 4 | $-C_4H_9$ | $-Cl$ | $-H$ | 1 | $-C_8H_{16}-$ | 701.0 |
| 5 | $-C_4H_9$ | $-SOC_2H_5$ | $-CH_3$ | 1 | $-C_4H_8-$ | 756.0 |
| 6 | $-C_4H_9$ | $-SO_2C_2H_5$ | $-CH_3$ | 1 | $-C_4H_8-$ | 788.0 |

General Formula (K)

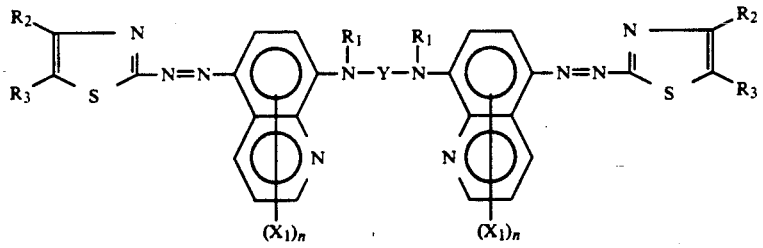

| No. | $R_1$ | $R_2$ | $R_3$ | $X_1$ | n | Y | M.W. |
|---|---|---|---|---|---|---|---|
| 1 | $-C_2H_5$ | $-H$ | $-NO_2$ | $-CH_3$ | 1 | $-C_6H_{12}-$ | 766.0 |
| 2 | $-C_4H_9$ | $-H$ | $-NO_2$ | $-OC_2H_5$ | 1 | $-C_6H_{12}-$ | 882.0 |
| 3 | $-C_4H_9$ | $-H$ | $-NO_2$ | $-NHCOCH_3$ | 1 | $-C_8H_{16}-$ | 936.0 |

General Formula (L)

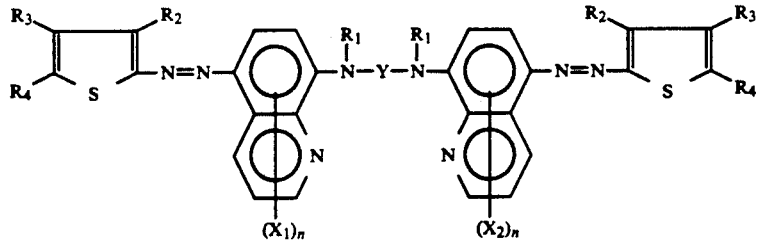

| No. | $R_1$ | $R_2$ | $R_3$ | $R_4$ | $X_1$ | n | Y | M.W. |
|---|---|---|---|---|---|---|---|---|

TABLE 1-continued

| | | | | | | | | |
|---|---|---|---|---|---|---|---|---|
| 1 | $-C_2H_5$ | $-NO_2$ | $-H$ | $-CN$ | $-CH_3$ | 1 | $-C_6H_{12}-$ | 814.0 |
| 2 | $-C_4H_9$ | $-NO_2$ | $-H$ | $-COOC_2H_5$ | $-H$ | 1 | $-C_6H_{12}-$ | 936.0 |
| 3 | $-C_4H_9$ | $-NO_2$ | $-H$ | $-NO_2$ | $-CH_3$ | 1 | $-C_8H_{16}-$ | 938.0 |
| 4 | $-C_4H_9$ | $-CN$ | $-CH_3$ | $-CN$ | $-CONHCH_3$ | 1 | $-C_6H_{12}-$ | 944.0 |
| 5 | $-C_4H_9$ | $-CN$ | $-H$ | $-C_2H_4COOCH_3$ | $-CH_3$ | 1 | $-C_6H_{12}-$ | 952.0 |
| 6 | $-C_4H_9$ | $-CN$ | $-H$ | $-CN$ | $-H$ | 1 | $-C_6H_{12}-$ | 802.0 |

General Formula (M)

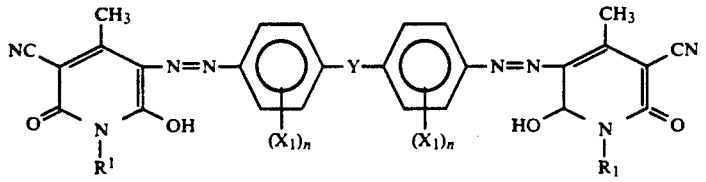

| No. | $R_1$ | $X_1$ | n | Y | M.W. |
|---|---|---|---|---|---|
| 1 | $-C_6H_{13}$ | $-H$ | 1 | $-C_6H_{12}-$ | 758.0 |
| 2 | $-C_2H_5$ | $-CH_3$ | 1 | $-C_8H_{16}-$ | 702.0 |
| 3 | $-C_2H_5$ | $-OC_2H_5$ | 1 | $-C_6H_{12}-$ | 734.0 |
| 4 | $-C_2H_5$ | $-NHCOCH_3$ | 1 | $-C_6H_{12}-$ | 760.0 |
| 5 | $-C_4H_9$ | $-CH_3$ | 1 | $-COOC_2H_4OOC-$ | 762.0 |
| 6 | $-C_2H_5$ | $-H$ | 1 | $-C_2H_4OC_2H_4-$ | 634.0 |

General Formula (N)

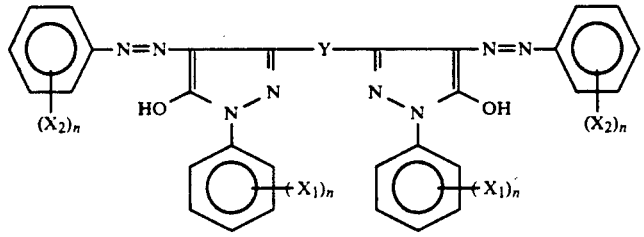

| No. | $X_1$ | n | $X_2$ | n | Y | M.W. |
|---|---|---|---|---|---|---|
| 1 | $-H$ | 1 | $-COOCH_3$ | 1 | $-C_6H_{12}-$ | 704.0 |
| 2 | $-CH_3$ | 1 | $-CN$ | 1 | $-C_8H_{16}-$ | 694.0 |
| 3 | $-OC_2H_5$ | 1 | $-Cl$ | 1 | $-C_6H_{12}-$ | 745.0 |
| 4 | $-NHCOCH_3$ | 1 | $-H$ | 1 | $-C_6H_{12}-$ | 702.0 |

General Formula (O)

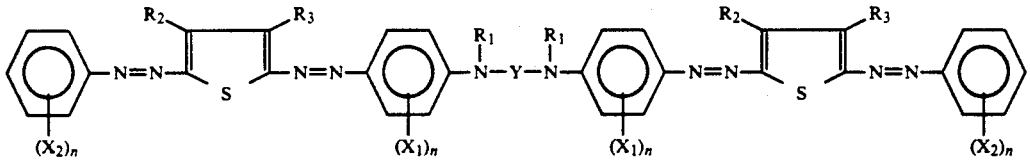

| No. | $R_1$ | $R_2$ | $R_3$ | $X_1$ | n | $X_2$ | n | Y | M.W. |
|---|---|---|---|---|---|---|---|---|---|
| 1 | $-C_2H_5$ | $-CN$ | $-CH_3$ | $-NHCOCH_3$ | 1 | $-H$ | 1 | $-C_4H_8-$ | 916.0 |
| 2 | $-C_4H_9$ | $-CN$ | $-H$ | $-CH_3$ | 1 | $-H$ | 1 | $-C_4H_8-$ | 858.0 |
| 3 | $-C_4H_9$ | $-COCH_3$ | $-H$ | $-CH_3$ | 1 | $-H$ | 1 | $-C_6H_{12}-$ | 920.0 |
| 4 | $-C_4H_9$ | $-COOCH_3$ | $-H$ | $-CH_3$ | 1 | $-H$ | 1 | $-C_4H_8-$ | 952.0 |
| 5 | $-C_4H_9$ | $-CN$ | $-CH_3$ | $-CH_3$ | 1 | $-H$ | 1 | $-C_4H_8-$ | 886.0 |
| 6 | $-C_4H_9$ | $-CN$ | $-H$ | $-Cl$ | 1 | $-H$ | 1 | $-C_4H_8-$ | 899.0 |
| 7 | $-H$ | $-H$ | $-H$ | $-H$ | 1 | $-H$ | 1 | $-C_6H_{12}-$ | 696.0 |

General Formula (P)

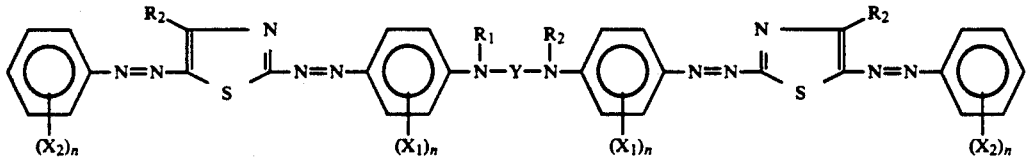

| No. | $R_1$ | $R_2$ | $X_1$ | n | $X_2$ | n | Y | M.W. |
|---|---|---|---|---|---|---|---|---|
| 1 | $-C_2H_5$ | $-H$ | $-CH_3$ | 1 | $-H$ | 1 | $-C_6H_{12}-$ | 782.0 |
| 2 | $-C_4H_9$ | $-H$ | $-NHCOCH_3$ | 1 | $-H$ | 1 | $-C_6H_{12}-$ | 924.0 |
| 3 | $-C_4H_9$ | $-CH_3$ | $-CH_3$ | 1 | $-H$ | 1 | $-C_4H_8-$ | 838.0 |

TABLE 1-continued

| | | | | | | | | |
|---|---|---|---|---|---|---|---|---|
| 4 | $-C_4H_9$ | $-CH_3$ | $-NHCOCH_3$ | 1 | $-H$ | 1 | $-C_6H_{12}-$ | 952.0 |
| 5 | $-H$ | $-H$ | $-H$ | 1 | $-H$ | 1 | $-C_6H_{12}-$ | 698.0 |

General Formula (Q)

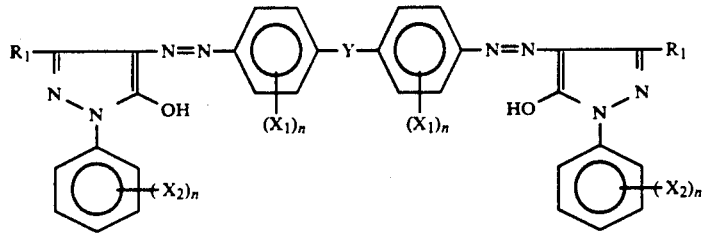

| No. | $R_1$ | $X_1$ | n | $X_2$ | n | Y | M.W. |
|---|---|---|---|---|---|---|---|
| 1 | $-CH_3$ | $-H$ | 1 | $-Cl$ | 1 | $-COOC_2H_4OOC-$ | 683.0 |
| 2 | $-CH_3$ | $-NHCOCH_3$ | 1 | $-H$ | 1 | $-COOC_2H_4OOC-$ | 728.0 |
| 3 | $-COOC_2H_5$ | $-H$ | 1 | $-CN$ | 1 | $-COOC_4H_8OOC-$ | 808.0 |
| 4 | $-COOC_3H_7$ | $-CH_3$ | 1 | $-NO_2$ | 1 | $-COOC_2H_4OOC-$ | 876.0 |

General Formula (R)

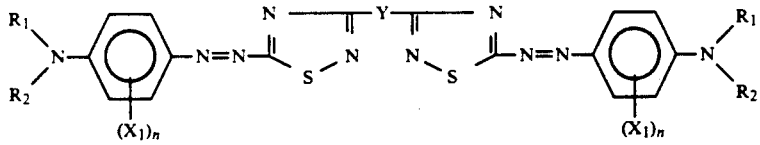

| No. | $R_1$ | $R_2$ | $X_1$ | n | Y | M.W. |
|---|---|---|---|---|---|---|
| 1 | $-CH_3$ | $-CH_3$ | $-NHCOC_2H_5$ | 1 | $-C_4H_8-$ | 662.0 |
| 2 | $-C_2H_5$ | $-C_2H_5$ | $-CH_3$ | 1 | $-NHC_2H_4HN-$ | 606.0 |
| 3 | $-C_2H_5$ | $-C_2H_4OH$ | $-H$ | 1 | $-COOC_2H_4OOC-$ | 668.0 |
| 4 | $-C_2H_5$ | $-C_2H_5$ | $-OC_2H_5$ | 1 | $-C_6H_{12}-$ | 692.0 |

The heat transfer sheet according to this invention is characterized by using such specific dyes as described above, and may otherwise be similar to conventional heat transfer sheets hitherto available in the art.

As the substrate sheets used for the instant heat transfer sheets containing the above-mentioned dyes, use may be made of any material heretofore known in the art and having some heat resistance and strength. For instance, mention is made of papers including various processed papers, polyester films, polystyrene films, polypropylene films, polysulfone films, polycarbonate films, aramide films, polyvinyl alcohol films and cellophane, all having a thickness of 0.5 to 50 μm, preferably 3 to 10 μm. Particular preference is given to polyester films.

The dye carrier layer formed on the surface of such a substrate sheet as mentioned above is a layer in which the dye expressed by the general formula (I) is carried by any desired binder resin.

As the binder resin for carrying the dye, use may be made of any conventional resin heretofore known in the art. For instance, preference is given to cellulosic resins such as ethyl cellulose, hydroxyethyl cellulose, ethylhydroxy cellulose, hydroxypropyl cellulose, methyl cellulose, cellulose acetate and cellulose acetate butyrate; and vinylic resins such as polyvinyl alcohol, polyvinyl acetate, polyvinyl butyral, polyvinyl acetal, polyvinyl pyrrolidone and polyacrylamide. Among others, particular preference is given to polyvinyl butyral and polyvinyl acetal due to their heat resistance, dye mobility and other properties.

Basically formed of the above-mentioned material, the dye carrier layer of the instant heat transfer sheet may additionally contain various additives heretofore known in the art at need.

Such a dye carrier layer is preferably obtained by dissolving or dispersing the above-mentioned dye, binder resin and other desired components in a suitable solvent to prepare a coating or ink liquid for forming the carrier layer and coating and drying it on the above-mentioned substrate sheet.

The thus formed carrier layer has a thickness of 0.2 to 5.0 μm, preferably about 0.4 to 2.0 μm, and suitably contains the dye in an amount of 5 to 70% by weight, preferably 10 to 60% by weight based on its weight.

The heat transfer sheet according to this invention, which well serves the heat transfer purpose as such, may further be provided with an anti-tack or release layer on the surface of the dye carrier layer. Such a layer prevents adhesion of the heat transfer sheet to the material to be transferred during heat transfer printing, making it possible to form an image of more improved density by applying more increased heat transfer temperatures.

For this release purpose, some effects may be obtained only by depositing an anti-tack inorganic powder onto the dye carrier layer. Alternatively, the release layer may be formed of a resin excelling in releasability such as silicone, acrylic and fluorinated polymers with a thickness of 0.01 to 5 μm, preferably 0.05 to 2 μm.

It is noted that sufficient effects are also obtained by incorporating the inorganic powder or releasing polymer into the dye carrier layer.

Additionally, the present heat transfer sheet may be provided on its back side with a heat-resistant layer to prevent the heat of a thermal head from producing an adverse influence thereupon.

The material to be heat-transferred to form an image with such a heat transfer sheet as described above may be any material having on its recording surface a layer capable of receiving the dye. Alternatively, such a material may be provided by forming a dye-receiving layer separately on at least one side of paper, a metal, glass or a synthetic resin including no dye-receiving layer.

For instance, the materials to be heat-transferred, which may not be provided with any dye-receiving layer, include fibers, woven fabrics, films, sheets and formings of polyolefinic resins such as polypropylene; halogenated polymers such as polyvinyl chloride and polyvinylidene chloride; vinyl polymers such as polyvinyl acetate and polyacrylic ester; polyester type resins such as polyethylene terephthalate and polybutylene terephthalate; polystyrene type resins; polyamide type resins; resins based on copolymers of olefins such as ethylene and propylene with other vinyl monomers; ionomers; and cellulosic resins such as cellulose diacetate. Particular preference is given to a polyester sheet or film or a processed paper having a polyester layer. The material to be transferred may also be formed of paper, a metal, glass or other non-dyeable substrate by coating and drying a solution or dispersion of such a dyeable resin as described above on its recording surface. Alternatively, a film of that resin may be laminated on the recording surface.

Additionally, the dyeable material to be transferred may be provided with a dye-receiving layer of a resin having a more improved dyeability, as is the case with the paper substrate.

The thus formed dye-receiving layer may be made of a material or materials, and may of course contain various additives, provided that the desired object is achievable.

Although not critical, such a dye-receiving layer may generally have a thickness of 3 to 50 μm. Although it is preferred that such a dye-receiving layer is in a continuous coating form, it may be provided in a discontinuous coating form, using a resin emulsion or dispersion.

Such a material to be transferred is basically constructed as described above, and may well serve its own purpose as such. However, an anti-tack inorganic powder may be incorporated into the material to be transferred or its dye-receiving layer. This makes it possible to prevent adhesion between the heat transfer sheet and the material to be transferred even at more elevated heat transfer temperatures, thereby carrying out more satisfactory heat transfer. Particular preference is given to finely divided silica.

In place of or in combination with the inorganic powder such as silica, another resin having a more improved releasability may be added, as already described. A particularly preferred releasing polymer is a cured product of a silicone compound, e.g., a cured product of an epoxy-modified silicone oil and an amino-modified silicone oil. Preferably, such a release agent accounts for about 0.5 to 30% by weight of the dye-receiving layer.

In order to impart a more improved anti-tack effect to the material to be transferred, such an inorganic powder as described above may be deposited onto the surface of its dye-receiving layer. Alternatively, a layer containing such a release agent having an improved releasability as described above may be provided.

At a thickness of about 0.01 to 5 μm, such a release layer produces an effect so satisfactory that it can prevent adhesion between the dye-receiving layers of the heat transfer sheet and material to be transferred, while improving the dye receptivity further.

When carrying out heat transfer printing with the present heat transfer sheet and the above-mentioned material to be recorded, the heat energy applying means used may be any known applying means. For instance, the desired object may be well-achieved by the application of a heat energy of about 5 to 100 mJ/mm$^2$, while the recording time is controlled with a recorder such as a thermal printer (e.g., Video Printer VY-100 commercialized by Hitachi, Ltd., Japan).

According to this invention as illustrated above, the dye used to construct the present heat transfer sheet shows an increased heat-transferability and exhibits dyeability and color developability with respect to the material to be transferred, since although it has a molecular weight much higher than that of the sublimable dye (having a molecular weight of about 150 to 250) used with conventional heat transfer sheets, yet it assumes a specific structure and includes a substituent at a specific position. This dye is also unlikely to migrate or bleed through the material to be transferred after transfer.

While the obtained image is formed by the dye, there are no discoloration/fading problems by indoor light in particular. Nor are there any discoloration/fading problems under conditions not directly exposed to light, as encountered in albums, cases or books.

Thus, various problems of the prior art can all be solved, because the image formed with the instant heat transfer sheet is so improved in terms of fastness properties, especially resistance to transfer and contamination as well as resistance to discoloration and fading that, even when stored over an extended period of time, it likely will not most unlikely to lose sharpness and clearness or contaminate other articles.

The present invention will now be explained more illustratively with reference to the examples and comparative examples, in which unless otherwise stated, the "parts" and "%" are given by weight.

EXAMPLES

A number of dye carrier layer-forming ink compositions comprising the following components were prepared and coated on a 6-μm thick polyethylene terephthalate film subjected on its back side to a heat-resistant treatment in an amount of 1.0 g/m$^2$ on dry basis, followed by drying. In this way, a number of heat transfer sheets according to this invention were obtained.

| | |
|---|---|
| Dyes specified in Table 1 | 3 parts |
| Polyvinyl butyral resin | 4.5 parts |
| Methyl ethyl ketone | 46.25 parts |
| Toluene | 46.25 parts |

However, when the dyes were insoluble in the above-mentioned compositions, DMF, dioxane, chloroform and so on were optionally used as solvents.

Then, a coating liquid comprising the following components was coated on one side of a synthetic paper (Yupo FPG#150 commercialized by Oji Yuka Co., Ltd., Japan) used as a substrate sheet at a ratio of 10.0 g/m$^2$ on dry basis, followed by drying at 100° C. for 30 minutes. In this way, a material to be transferred was obtained.

| | |
|---|---|
| Polyester resin (Vylon 200 commercialized by Toyobo Co., Ltd., Japan) | 11.5 parts |
| Vinyl chloride/vinyl acetate copolymer (VYHH commercialized by UCC) | 5.0 parts |
| Amino-modified silicone (KF-393 commercialized by the Shin-Etsu Chemical Co., Ltd., Japan) | 1.2 parts |
| Epoxy-modified silicone (S-22-343 commercialized by the Shin-Etsu Chemical Co., Ltd., Japan) | 1.2 parts |
| Methyl ethyl ketone/toluene/cyclohexanone (at a weight ratio of 4:4:2) | 102.0 parts |

Each of the instant heat transfer sheets was overlaid on the above-mentioned material to be transferred, while their dye carrier layer and dye-receiving surface were located in opposition to each other. Recording was then performed from the back side of the heat transfer sheet at a head application voltage of 10 V for 4.0 msec. with a thermal head. The results are set out in Table 2.

TABLE 2

| Dyes | Color Density | Storability | Color Tone |
|---|---|---|---|
| A-1 | 1.92 | ⊚ | Red |
| A-2 | 2.04 | ⊚ | Red |
| A-3 | 1.84 | ⊚ | Red |
| A-4 | 1.70 | ⊚ | Red |
| B-1 | 1.91 | ⊚ | Red |
| B-2 | 2.08 | ⊚ | Red |
| B-3 | 2.02 | ⊚ | Red |
| B-4 | 1.86 | ⊚ | Red |
| B-5 | 1.60 | ⊚ | Red |
| B-6 | 1.72 | ⊚ | Red |
| B-7 | 2.34 | ⊚ | Red |
| C-1 | 1.88 | ⊚ | Blue |
| C-2 | 1.65 | ⊚ | Blue |
| C-3 | 1.59 | ⊚ | Blue |
| D-1 | 1.75 | ⊚ | Red |
| D-2 | 1.97 | ⊚ | Red |
| D-3 | 1.87 | ⊚ | Red |
| D-4 | 1.58 | ⊚ | Red |
| E-1 | 1.94 | ⊚ | Red |
| E-2 | 1.91 | ⊚ | Red |
| E-3 | 1.99 | ⊚ | Red |
| E-4 | 1.63 | ⊚ | Red |
| F-1 | 1.76 | ⊚ | Blue |
| F-2 | 1.63 | ⊚ | Blue |
| F-3 | 1.50 | ⊚ | Blue |
| F-4 | 1.72 | ⊚ | Blue |
| F-5 | 1.67 | ⊚ | Blue |
| F-6 | 2.07 | ⊚ | Blue |
| G-1 | 1.53 | ⊚ | Blue |
| G-2 | 1.51 | ⊚ | Blue |
| G-3 | 1.60 | ⊚ | Blue |
| H-1 | 2.17 | ⊚ | Blue |
| H-2 | 1.95 | ⊚ | Red |

TABLE 2-continued

| Dyes | Color Density | Storability | Color Tone |
|---|---|---|---|
| H-3 | 1.59 | ⊚ | Red |
| H-4 | 1.67 | ⊚ | Red |
| H-5 | 1.66 | ⊚ | Blue |
| I-1 | 2.06 | ⊚ | Red |
| I-2 | 1.93 | ⊚ | Red |
| I-3 | 1.77 | ⊚ | Red |
| I-4 | 2.00 | ⊚ | Red |
| J-1 | 2.05 | ⊚ | Red |
| J-2 | 1.82 | ⊚ | Red |
| J-3 | 1.78 | ⊚ | Red |
| J-4 | 2.01 | ⊚ | Red |
| J-5 | 1.90 | ⊚ | Red |
| J-6 | 1.76 | ⊚ | Red |
| K-1 | 1.64 | ⊚ | Blue |
| K-2 | 1.50 | ⊚ | Blue |
| K-3 | 1.32 | ⊚ | Blue |
| L-1 | 1.63 | ⊚ | Blue |
| L-2 | 1.43 | ⊚ | Blue |
| L-3 | 1.32 | ⊚ | Blue |
| L-4 | 1.57 | ⊚ | Blue |
| L-5 | 1.54 | ⊚ | Blue |
| L-6 | 1.73 | ⊚ | Blue |
| M-1 | 1.89 | ⊚ | Yellow |
| M-2 | 2.00 | ⊚ | Yellow |
| M-3 | 1.94 | ⊚ | Yellow |
| M-4 | 1.83 | ⊚ | Yellow |
| M-5 | 1.90 | ⊚ | Yellow |
| M-6 | 2.10 | ⊚ | Yellow |
| N-1 | 2.08 | ⊚ | Yellow |
| N-2 | 2.00 | ⊚ | Yellow |
| N-3 | 1.99 | ⊚ | Yellow |
| N-4 | 1.94 | ⊚ | Yellow |
| O-1 | 1.60 | ⊚ | Blue |
| O-2 | 1.63 | ⊚ | Blue |
| O-3 | 1.54 | ⊚ | Blue |
| O-4 | 1.46 | ⊚ | Blue |
| O-5 | 1.62 | ⊚ | Blue |
| O-6 | 1.58 | ⊚ | Blue |
| O-7 | 2.07 | ⊚ | Blue |
| P-1 | 1.91 | ⊚ | Blue |
| P-2 | 1.48 | ⊚ | Blue |
| P-3 | 1.70 | ⊚ | Blue |
| P-4 | 1.45 | ⊚ | Blue |
| P-5 | 1.96 | ⊚ | Blue |
| Q-1 | 2.03 | ⊚ | Yellow |
| Q-2 | 1.98 | ⊚ | Yellow |
| Q-3 | 1.78 | ⊚ | Yellow |
| Q-4 | 1.50 | ⊚ | Yellow |
| R-1 | 2.11 | ⊚ | Red |
| R-2 | 2.25 | ⊚ | Red |
| R-3 | 1.84 | ⊚ | Red |
| R-4 | 1.98 | ⊚ | Red |

COMPARATIVE EXAMPLES 1-4

Example 1 was repeated, provided that the dyes reported in Table 3 were used in place of the dyes of Example 1.

TABLE 3

| Dyes | Color Density | Storability | Molecular Weight | Color Tone |
|---|---|---|---|---|
| 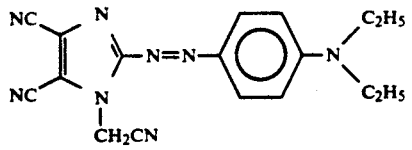 | 2.30 | Δ | 332 | Red |
| 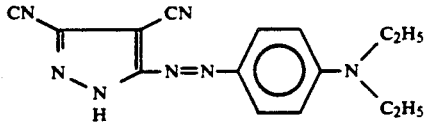 | 2.28 | Δ | 321 | Red |

TABLE 3-continued
| Dyes | Color Density | Storability | Molecular Weight | Color Tone |
|---|---|---|---|---|
| 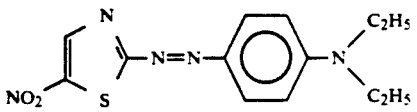 | 2.37 | X | 305 | Blue |
| 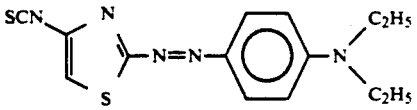 | 2.25 | Δ | 367 | Red |
| 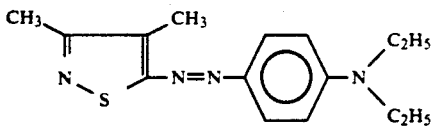 | 2.40 | X | 299 | Red |
| 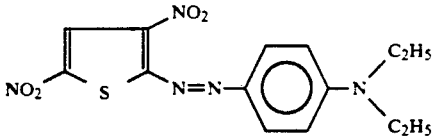 | 2.27 | Δ | 337 | Blue |
| 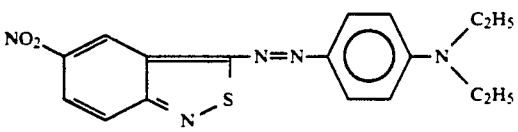 | 2.23 | Δ | 335 | Blue |
| 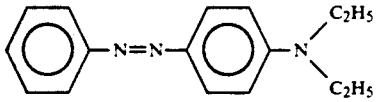 | 2.54 | X | 253 | Yellow |
| 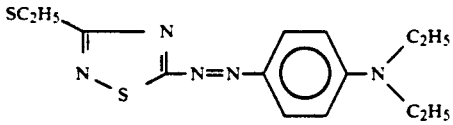 | 2.27 | Δ | 321 | Red |
| 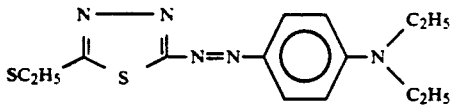 | 2.27 | Δ | 321 | Blue |
| 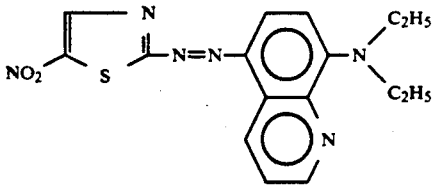 | 2.15 | Δ | 356 | Blue |
| 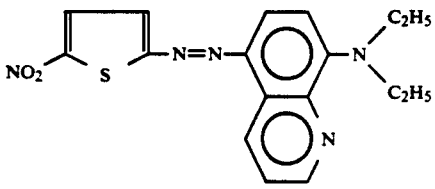 | 2.28 | Δ | 355 | Blue |

TABLE 3-continued

| Dyes | Color Density | Storability | Molecular Weight | Color Tone |
|---|---|---|---|---|
| 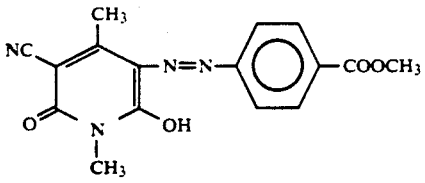 | 2.38 | Δ | 326 | Yellow |
| 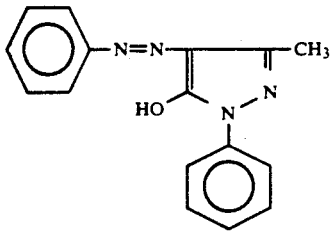 | 2.48 | X | 278 | Yellow |
| 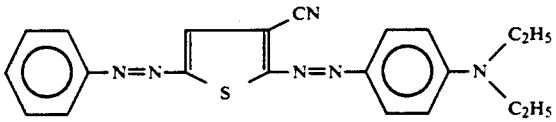 | 2.22 | | 388 | Blue |
| 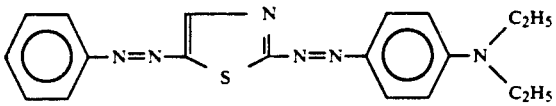 | 2.25 | Δ | 364 | Blue |

It is noted that the color density values reported were measured with a densitometer QD-918 commercialized by Macbeth Co., Ltd., U.S.A.

Storability was measured after the recorded images had been allowed to stand for 48 hours in an atmosphere of 70° C. and estimated by:

Double circle (◎):

the images underwent no change in sharpness and white paper was not colored even when it was rubbed with the images.

Circle (○):

the images lost sharpness slightly and white paper was slightly colored.

Triangle (Δ):

the images lost sharpness and white paper was colored.

Cross (x):

the images became blurred and white paper was severely colored.

We claim:

1. A heat transfer sheet comprising a substrate sheet and a dye carrier layer formed on one side of said substrate sheet, said dye carrier layer comprising a dye containing chromophores resulting from at least two azo bonds linked together through a non-conjugated linking group comprising an unsubstituted or substituted alkylene group.

2. The heat transfer sheet of claim 1, wherein said dye has a molecular weight of 500 to 1,000.

3. The heat transfer sheet of claim 1, wherein said dye has a molecular weight of 800 or less.

4. The heat transfer sheet of claim 1, wherein said dye has a melting point of 200° C. or lower.

5. A heat transfer sheet comprising a substrate sheet and a dye carrier layer formed on one side of said substrate sheet, said dye carrier layer comprising a dye containing chromophores resulting from at least two azo bonds linked together through a non-conjugated linking group comprising an alkylene group having from 2 to 10 carbon atoms which may contain different atoms.

* * * * *